United States Patent [19]

Clayfield et al.

[11] 4,153,419

[45] May 8, 1979

[54] AGGLOMERATION OF COAL FINES

[75] Inventors: Eric J. Clayfield, Mickle Trafford, near Chester; Clive Pinnington, Farndon, near Chester; Michael J. Cannon, Chester; Peter Sant, Wirral, all of England

[73] Assignee: Shell Oil Company, Houston, Tex.

[21] Appl. No.: 855,510

[22] Filed: Nov. 28, 1977

[30] Foreign Application Priority Data

Dec. 3, 1976 [GB] United Kingdom ..... 50506/76

[51] Int. Cl.[2] ..... C10L 5/16; C10L 5/40

[52] U.S. Cl. ..... 44/23; 44/6; 44/24

[58] Field of Search ..... 44/6, 23, 24

[56] References Cited

U.S. PATENT DOCUMENTS

| | | | |
|---|---|---|---|
| 2,618,537 | 11/1952 | Rabu | 44/23 |
| 3,307,927 | 3/1967 | Müschenborn et al. | 44/23 X |
| 3,775,070 | 11/1973 | Messer et al. | 44/23 X |
| 3,856,668 | 12/1974 | Shubert | 210/24 |
| 4,033,729 | 7/1977 | Capes et al. | 44/6 X |

FOREIGN PATENT DOCUMENTS

| | | |
|---|---|---|
| 575222 | 4/1924 | France. |
| 996575 | 2/1951 | France. |
| 59870 | 2/1954 | France. |

*Primary Examiner*—Carl Dees

[57] ABSTRACT

Process for the agglomeration of coal fines characterized by the staged addition of an aqueous emulsion of an oil fraction to an aqueous slurry of the fines.

22 Claims, No Drawings

AGGLOMERATION OF COAL FINES

BACKGROUND OF THE INVENTION

In coal mining techniques, wet fines with small diameters (e.g., of less than 1.5 mm) are generated, mostly as aqueous slurries. The fines comprise particles which are rich in coal and particles which are rich in inorganic material (also called ash). Techniques have been developed to separate at least part of the ash from the coal, with simultaneous preparation of coal agglomerates with a low ash content. These techniques may also be used for the agglomeration of coal fines from slurries thereof which do not contain ash. In order to prepare the coal agglomerates, an oil fraction is added as a binder to the slurry fines, by which binder the coal particles are preferably wetted and agglomerated. Ash particles are not, or only to a slight extent, wetted by the oil fraction, and are not agglomerated to any substantial extent.

An unattractively large energy input is needed in these prior art processes to obtain the oil fraction in the slurry of fines in droplets of sufficiently small size. Again, a relatively large amount of the binder is needed in order to agglomerate the greater part or all of the coal particles present in the slurry of fines. Accordingly, there has existed a need for an improved process which would eliminate these disadvantages.

SUMMARY OF THE INVENTION

A method has now been found by which agglomeration of coal fines can be achieved with only small amounts of an oil fraction and a low energy input.

Accordingly, the invention comprises a process for the agglomeration of coal fines from an aqueous slurry thereof, with simultaneous ash-removal in case ash is present, which comprises addition to the said slurry of an aqueous of an oil fraction, agitation of the mixture, removal of agglomerates formed, and repetition at least once of the addition, and following treatment, with the remaining slurry.

DETAILED DESCRIPTION OF THE INVENTION

The oil fraction may consist of a tar or shale or rock oil fraction, but in most cases it will consist of a mineral oil fraction.

In general the mineral oil fraction present in the aqueous emulsion thereof will consist of higher components, preferably no material being present with a boiling point below 200° C. Very suitable are crude oils, bituminous fractions, deasphalted residual fractions, lubricating oils and gas oils.

The amount of water present in the aqueous emulsion of an oil fraction may vary between wide limits. In general amounts between 30 percent and 70 percent by weight, in particular between 40 percent and 60 percent by weight, of water on total emulsion are very suitable.

It is preferred that the aqueous emulsion of the oil fraction comprise a surface-active agent, because such an agent strongly reduces the energy input needed to emulsify the oil fraction and enables the formation of small oil droplets, which is of advantage in the agglomeration process of the coal fines. Moreover, by conditioning the surface of the coal particles the surface-active agent enables a reduction in the amount of oil needed.

The surface-active agent may consist of a cationic, a non-ionic or preferably an anionic detergent such as a fatty acid soap. Very suitable are alkali metal sulphates or sulphonates of aliphatic or alkyl aromatic compounds such as sodium $C_8$–$C_{20}$ alkylbenzene sulphonates, sodium $C_8$–$C_{20}$ alkyl sulphates (e.g., sodium dodecyl sulphate) and sodium $C_8$–$C_{18}$ secondary sulphates.

The amount of surface-active agent may vary between wide limits. In general, the amount of this agent will be between 0.01 percent and 5 percent by weight, preferably between 0.1 percent and 2 percent by weight on aqueous emulsion and between 20 and 200 ppm by weight, preferably between 40 and 150 ppm by weight, total solids (coal fines and ash) present in the feed.

The aqueous emulsion of the oil fraction must be added to the aqueous slurry of the fines in at least two steps, in each of which agglomerates are formed, because it has been found that the yield obtained as agglomerated coal is lower if the same amount of aqueous emulsion of the oil fraction is added in one step.

In general, the addition of the aqueous emulsion of the oil fraction in two steps is optimal, addition of the aqueous emulsion to the slurry remaining after the second step not giving an attractive higher yield of agglomerated coal if the extra equipment and energy input needed for such a third step are taken into account.

The total amount of oil (as aqueous emulsion) to be added to the fines may vary between wide limits; it is an advantage of the present method that the amounts are between 1 and 10 percent by weight, preferably between 2 and 6 percent by weight on total solids present in the feed.

The amount of oil added in the first step in general will be between 10 and 80 percent by weight, preferably between 30 and 50 percent by weight of the amount of oil (as aqueous emulsion) to be added in total to the aqueous slurry of fines.

The mixture obtained after the addition of the aqueous emulsion of an oil to the aqueous slurry of fines is to be agitated, which can be achieved by any suitable method, e.g., by stirring. The time of agitation necessary for agglomeration of the coal particles may depend on several factors, such as type of coal, stirring rate etc. In general agitation times between 1 and 10 minutes are very suitable.

The agglomerates formed, which in general will have diameters between 0.5 and 5 cm, can be removed by any suitable means e.g., centrifugation. It is preferred to remove the agglomerates with the aid of a vibrating sieve; the agglomerates remain on the sieve and the remaining slurry, which comprises non-aggregated coal fines and ash, passes through it.

It has been found to be of advantage to wash the agglomerates on the filter with water in order to remove ash which has adhered to the agglomerates, in particular in case the original aqueous slurry of fines had a high solids content.

Preferably, the addition of the aqueous emulsion of oil to the slurry of fines, agitation and removal of agglomerates formed is carried out continuously, as will be exemplified in the process scheme to be discussed below.

The aqueous slurry which becomes available after removal of the agglomerates formed is treated in a second step with an amount of the aqueous emulsion of the oil, agitated, and the agglomerates formed are removed in a way similar to that described above.

The agglomerates obtained in each step can be used separately or if desired, they may be combined. They can easily be dewatered to a water content below 10 percent by weight, e.g., by centrifuging. They can be used as fuel or fuel components and are very suitable as components of fluid fuels prepared by incorporating them into a mineral oil.

EXAMPLE 1

An aqueous slurry containing 20 percent by weight solids with an ash content of 35 percent by weight (dry basis) was pumped at a rate of 4,000 ml/min into an agglomeration vessel which consisted of a baffled tank. In this tank a six-bladed stirrer was rotating at 400 rpm. An emulsion of heavy gas oil in water (1:1) was prepared by means of an ultrasonic transducer. The emulsion contained 0.1 percent by weight of surface-active material (Teepol 610®, a mixture of sodium $C_8$–$C_{18}$ secondary alkyl sulphates). The emulsion was continuously metered into the slurry at a rate of 2.5 percent oil with respect to the feed solids before the coal slurry entered the baffled tank. The mean residence time in agglomeration vessel was 3 minutes after which the agglomerated coal together with the ash forming mineral matter overflowed a weir onto a vibrating screen of 161 μm aperture mesh. The agglomerated coal was retained on the screen while the suspension of ash together with some coal fines passed through and was pumped to a second agglomeration vessel similar to the first. The same amount as before of the aqueous emulsion of heavy gas oil was metered into the slurry and after stirring for 2 minutes the suspension was passed onto a second vibrating sieve which retained the residual agglomerated coal while allowing the ash to pass through. Whereas the ash content of the feed material was 35 percent, the ash content of the agglomerated product from the two sieves was 7 percent and 10 percent respectively. The overall coal recovery was 95%.

EXAMPLE 2

An aqueous coal slurry containing 38 percent by weight solids with an ash content of 44 percent by weight (dry basis) was treated as described in Example 1. The combined coal agglomerates had an ash content of 20 percent by weight; if they were water washed on the screens the ash content dropped to 11 percent by weight. The coal recovery was 92 percent.

EXAMPLE 3

An aqueous coal slurry containing 7 percent by weight solids with an ash content of 44 percent by weight (dry basis) was treated as described in Example 1, except the surface-active material was added in an amount of 0.07 percent by weight in emulsion and consisted of sodium salts of compounds with formula

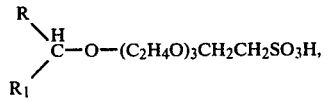

$$\begin{array}{l} R \diagdown \\ \quad H \\ \quad C-O-(C_2H_4O)_3CH_2CH_2SO_3H, \\ R_1 \diagup \end{array}$$

in which R and R′ are alkyl radicals with a total of 5 carbon atoms. The combined agglomerated coal had an ash content of 8 percent by weight; the coal recovery was 96 percent.

EXAMPLE 4

Several experiments were carried out similar to that of Example 1, in which the amounts of surface-active agent used were varied. The aqueous coal slurry used was the same as in Example 3. The results are depicted in FIG. 2 in which the amount of surface-active agent used in ppm by weight on total solids in the feed is plotted on the abscissa against the percentage coal recovery on the ordinate. The ash content of the agglomerates obtained was between 7 and 8 percent in all cases.

What is claimed is:

1. Process for the agglomeration of coal fines from an aqueous slurry thereof, with simultaneous ash removal where ash is present in the slurry, comprising:

(a) adding an aqueous emulsion of an oil fraction to said slurry, (b) agitating said emulsion and said slurry to form agglomerates and remaining slurry, (c) removing agglomerates formed, from the remaining slurry, (d) adding additional aqueous emulsion of an oil fraction to the remaining slurry, (e) agitating said emulsion and said remaining slurry to form agglomerates and remaining liquid, and (f) removing the agglomerates from the remaining liquid.

2. The processs of claim 1 wherein the oil fraction comprises a tar, shale, rock oil, or mineral oil fraction.

3. The process of claim 2 wherein the mineral oil fraction has a boiling point above 200° C.

4. The process of claim 1 wherein the amount of water present in the aqueous emulsion of an oil fraction is between 30 and 70 percent by weight.

5. The process of claim 1 wherein the aqueous emulsion of the oil fraction contains a surface active agent.

6. The process of claim 5 wherein the surface-active agent consists of a cationic, a non-ionic, or an anionic detergent.

7. The process of claim 6 wherein the surface-active agent consists of alkali metal sulphates or sulphonates of aliphatic or alkyl compounds selected from sodium $C_8$–$C_{20}$ alkylbenzene sulphonates, sodium $C_8$–$C_{20}$ alkyl sulphates, and sodium $C_8$–$C_{18}$ secondary sulphates.

8. The process of claim 6 wherein the amount of surface-active agent is between 0.01 and 5 percent by weight, based on the weight of the aqueous emulsion, and 200 ppm weight, on total solids, coal fines and ash, present in the feed.

9. The process of claim 8 wherein the total amount of oil as aqueous emulsion to be added to the fines is between 1 and 10 percent by weight based on the total solids present in the feed.

10. The process of claim 9 wherein the amount of oil added to the aqueous slurry as aqueous emulsion is between 10 and 80 percent by weight the amount of oil as aqueous emulsion to be added in total to the aqueous slurry and the remaining slurry.

11. The process of claim 10 wherein the aqueous slurry of fines is agitated by stirring.

12. Process for the agglomeration of coal fines from an aqueous slurry thereof, with simultaneous ash removal where ash is present in the slurry, comprising:

(a) continuously combining an aqueous emulsion of an oil fraction and an aqueous slurry of coal fines in a first agglomeration vessel and continously removing agglomerates and remaining slurry from the first agglomeration vessel, the contents of said first vessel being continuously agitated, (b) removing agglomerates from the remaining slurry, (c) continuously combining an aqueous emulsion of an oil fraction and the remaining slurry in a second agglomeration vessel and continuously removing agglomerates and remaining liquid from the second agglomeration vessel, the contents of said second vessel being continuously agitated, and (d) removing agglomerates from the remaining liquid.

13. The process of claim 12 wherein the oil fraction comprises a tar, shale, rock oil, or mineral oil fraction.

14. The process of claim 12 wherein the mineral oil fraction has a boiling point above 200° C.

15. The process of claim 12 wherein the amount of water present in the aqueous emulsion of an oil fraction is between 30 and 70 percent by weight.

16. The process of claim 12 wherein the aqueous emulsion of the oil fraction contains a surface active agent.

17. The process of claim 16 wherein the surface-active agent consists of a cationic, or an anionic detergent.

18. The process of claim 17 wherein the surface-active agent consists of alkali metal sulphates or sulphonates of aliphatic or alkyl compounds selected from sodium $C_8$–$C_{20}$ alkylbenzene sulphonates, sodium $C_8$–$C_{20}$ alkyl sulphates, and sodium $C_8$–$C_{18}$ secondary sulphates.

19. The process of claim 17 wherein the amount of surface-active agent is between 0.01 and 5 percent by weight, based on the weight of the aqueous emulsion, and 200 ppm weight, on total solids, coal fines and ash, present in the feed.

20. The process of claim 19 wherein the total amount of oil as aqueous emulsion to be added to the fines is between 1 and 10 percent by weight based on the total solids present in the feed.

21. The process of claim 20 wherein the amount of oil added to the aqueous slurry as aqueous emulsion is between 10 and 80 percent by weight the amount of oil as aqueous emulsion to be added in total to the aqueous slurry and the remaining slurry.

22. The process of claim 21 wherein the aqueous slurry of fines is agitated by stirring.

* * * * *